US010507442B2

(12) United States Patent
Gordon et al.

(10) Patent No.: US 10,507,442 B2
(45) Date of Patent: Dec. 17, 2019

(54) VARIABLE FLOW-THROUGH CAVITATION DEVICE

(71) Applicant: Cavitation Technologies, Inc., Chatsworth, CA (US)

(72) Inventors: Roman Gordon, Studio City, CA (US); Igor Gorodnitsky, Marina del Rey, CA (US); Maxim A. Promtov, Tambov (RU); Naum Voloshin, Los Angeles, CA (US)

(73) Assignee: Cavitation Technologies, Inc., Chatsworth, CA (US)

( * ) Notice: Subject to any disclaimer, the term of this patent is extended or adjusted under 35 U.S.C. 154(b) by 302 days.

(21) Appl. No.: 15/375,809

(22) Filed: Dec. 12, 2016

(65) Prior Publication Data

US 2018/0161740 A1 Jun. 14, 2018

(51) Int. Cl.

| | |
|---|---|
| ***B01F 5/00*** | (2006.01) |
| ***B01F 5/06*** | (2006.01) |
| *B01F 3/08* | (2006.01) |

(52) U.S. Cl.

CPC .... *B01F 5/0688* (2013.01); *B01F 2003/0842* (2013.01); *B01F 2215/0036* (2013.01)

(58) Field of Classification Search

CPC ..... B01F 5/0688; B01F 5/069; B01F 7/0075–00758; B01F 13/1016; B01F 2003/0842; B01F 2215/0036

USPC ..... 366/302, 307

See application file for complete search history.

(56) References Cited

U.S. PATENT DOCUMENTS

| | | | | | |
|---|---|---|---|---|---|
| 1,727,753 | A * | 9/1929 | De Bethune | B01F 7/10 | 366/290 |
| 2,092,992 | A * | 9/1937 | Thalman | B01F 5/0683 | 241/101.5 |
| 2,734,728 | A * | 2/1956 | Myers | B01F 5/0683 | 241/161 |
| 2,893,846 | A * | 7/1959 | Wistrich | B01F 5/0683 | 196/46 |
| 3,013,780 | A * | 12/1961 | Wistrich | B01D 3/18 | 202/158 |
| 4,869,849 | A * | 9/1989 | Hirose | B01F 5/0682 | 261/78.2 |
| 5,810,474 | A * | 9/1998 | Hidalgo | B01F 5/0683 | 366/119 |

* cited by examiner

*Primary Examiner* — Anshu Bhatia

(74) *Attorney, Agent, or Firm* — Kelly & Kelley, LLP

(57) ABSTRACT

A flow-through cavitation device having an elongated housing with an inlet and an outlet. One or more variable multi-jet nozzles are disposed throughout the elongated housing with a working chamber following each variable multi-jet nozzle. Each variable multi-jet nozzle consists of a movable disk fixedly mounted on a central shaft and a stationary disk fixedly mounted on the housing and in contact with the rotating disk. The movable and stationary disks of each variable multi-jet nozzle have through channels. The flow cross-sectional area of the through channels is variable by rotating the movable disk relative to the stationary disk.

12 Claims, 14 Drawing Sheets

VARIABLE FLOW-THROUGH CAVITATION DEVICE

BACKGROUND OF THE INVENTION

The invention generally relates to the flow-through, high-shear mixers and cavitation apparati that are utilized for processing heterogeneous and homogeneous fluidic mixtures through the controlled formation of cavitation bubbles and uses the energy released upon the implosion of these bubbles to alter said fluids. The device is meant for preparing mixtures, solutions, emulsions and dispersions with the particle sizes that can be smaller than one micron, particle and nanoparticle synthesis and improving composition, mass and heat transfer and is expected to find applications in pharmaceutical, food, oil, chemical, fuel and other industries.

More particularly, the device relates to the modification of fluids composed of different compounds by using the implosion energy of cavitation bubbles to improve the homogeny, viscosity, and/or other physical characteristics of the fluids, as well as, alter their chemical composition, and obtain upgraded or altered products of higher value.

Cavitation can be of different origins, for instance, acoustic, hydrodynamic or generated with laser light, an electrical discharge or steam injection. (Young, 1999; Gogate, 2008; Mahulkar et al, 2008) Hydrodynamic cavitation comprises the vaporization, generation, growth, pulsation and collapse of bubbles which occur in a flowing liquid as a result of a decrease and subsequent increase in the hydrostatic pressure and can be achieved by passing the liquid through a constricted zone at sufficient velocity. Cavitation onsets after the hydrostatic pressure of the liquid has decreased to the saturated vapor pressure of the liquid or its components and is categorized by a cavitation number $C_v$. Cavitation ideally begins where $C_v$ equals 1, where a $C_v$ less than 1 indicates a high degree of cavitation. Other important considerations are the surface tension and size of bubbles and the number of cavitation events in a flow unit. (Gogate, 2008; Passandideh-Fard and Roohi, 2008).

The eventual collapse of the bubbles results in an localized increase in pressure and temperature. The combination of elevated pressure and temperature along with vigorous mixing supplied by the hydrodynamic cavitation process triggers and accelerates numerous reactions and processes. These actions enhance the reaction yield and process efficiency by means of the energy released upon the collapse of the cavitation bubbles. Such enhanced reaction yield and process efficiency has found application in mixing, emulsification and the expedition of chemical reactions. While extreme pressure or heat can be disadvantageous, the outcome of controlled cavitation-assisted processing has been shown to be beneficial.

When fluid is processed in a flow-through cavitation mixing device at a suitable velocity, the decrease in hydrostatic pressure results in the formation of cavitation bubbles. Small particles and impurities in the liquid serve as nuclei for these bubbles. When the cavitation bubbles relocate to a high-pressure zone they will implode within a short time. The collapse of bubbles is asymmetrical because the surrounding liquid rushes in to fill the void forming a micro jet that subsequently ruptures the bubble with tremendous force. The implosion is accompanied by a significant jump in both the local pressure and temperature up to 1,000 atm and 5,000° C., respectively, and the formation of shock waves. (Suslick, 1989; Didenko et al, 1999; Suslick et al, 1999; Young, 1999) The released energy activates atoms, molecules or radicals located in the bubbles and surrounding fluid, initiates reactions and processes and dissipates into the surrounding fluid. The implosion may be accompanied by the emission of UV radiation and/or visible light, which promotes photochemical reactions and generates radicals (Sharma et al, 2008; Zhang et al, 2008; Kalva et al, 2009).

Numerous flow-through hydrodynamic cavitation devices are known. See, for example, U.S. Pat. No. 6,705,396 to Ivannikov et al, U.S. Pat. Nos. 9,290,717, 7,314,306, 7,207,712, 7,086,777, 6,802,639, 6,502,979, 5,969,207, 5,971,601 5,492,654 and 5,969,207 to Kozyuk, U.S. Pat. Nos. 8,042,989 and 7,762,715 to Gordon et al., U.S. Pat. No. 7,815,810 to Bhalchandra et al, and U.S. Pat. No. 7,585,416 to Ranade et al.

U.S. Pat. No. 7,086,777 to Kozyuk discloses a device for creating hydrodynamic cavitation in fluids which includes a flow-through chamber intermediate an inlet opening and an outlet opening. The flow-through chamber having an upstream opening portion communicating with the inlet opening and a downstream opening portion communicating with the outlet opening. The cross-sectional area of the upstream opening portion being greater than the cross-sectional area of the upstream opening portion. At least two cavitation generators located chamber for generating a hydrodynamic cavitation field downstream from each respective cavitation generator.

In contrast to sonic or ultrasonic cavitation devices, the flow-through hydrodynamic apparatuses do not require using a vessel. The efficiency of sonic or ultrasonic processing performed in a static vessel is insufficient because the effect diminishes with an increase in distance from the radiation source. The achieved fluid alterations are not uniform and occur at specific locations in the vessel, depending on the frequency and interference patterns. Thus, processing fluids via sonic or ultrasonic cavitation does not offer an optimized method.

At the present time, with energy costs rapidly rising, it is highly desirable to reduce both treatment time and energy consumption to secure a profit margin as large as possible. However, the prior art techniques do not offer the most efficient and safest methods of blending, emulsifying, altering or upgrading fluids in the shortest time possible. An advanced, compact, and highly efficient device is particularly needed at pharmaceutical plants and feedstock processing locations and refineries, where throughput is a key factor. The present invention provides such a device while upgrading products expeditiously.

SUMMARY OF THE INVENTION

The present invention provides a unique method for manipulating fluids. This goal is achieved via the adjustment of the flow section of nozzles design of a multi-stage flow-through cavitation mixing device aimed at the expeditious control of hydrodynamic cavitation. In accordance with the present invention, the method comprises feeding fluidic flow with a discharge pump and/or a downstream suction pump set at proper pressure in an array of low-pressure and high-pressure chambers separated with vortex turbulizers to afford the compact adjustment of the flow section of multi-jet nozzles design, advanced turbulithation, rapid mass transfer, high treatment efficiency and superior capacity, and supplying other conditions of choice.

In addition to the objects and advantages of the fluids' manipulation described in this patent application, several objects and advantages of the present invention are:

(1) to provide a compact flow-through cavitation device for processing fluids in an expedited manner with control of hydrodynamic cavitation, optimized energy and maintenance costs;

(2) to reduce space taken up by the processing equipment;

(3) to provide conditions for blending, emulsification, altering and upgrading fluids and flammable reagents by passing them through the controlled hydrodynamic cavitation multi-jet nozzles that house a high-pressure chamber wherein the cavitation bubbles' implosion occurs;

(4) to provide conditions for gradual, multi-step alteration of fluids by subjecting them to the first controlled cavitation event followed by subjecting the residual original compounds and products of the reactions to the second controlled cavitation event, etc.

(5) to provide a compact, adjustable flow section of multi-jet nozzles, flow-through device for manipulating fluids at the site of production;

(6) to generate a controlled cavitation field throughout the reaction chamber for a time period allowing the desired changes to take place.

The present invention is directed to a variable flow-through cavitation device. The device includes an elongated housing having an inlet and an outlet defining a flowpath, a rotatable shaft disposed along a central axis of the elongated housing, and a variable multi-jet nozzle disposed in the flowpath. The variable multi-jet nozzle consists of a rotatable or movable disk abutting against a stationary disk, wherein the rotatable or movable disk is fixedly secured to the rotatable shaft and freely rotatable relative to the elongated housing, and wherein the stationary disk is fixedly secured to the elongated housing and the rotatable shaft passes freely through the stationary disk. The variable multi-jet nozzle has a plurality of through channels that consist of a plurality of first channels through the rotatable or movable disk and a plurality of second channels through the stationary disk. An alignment of the plurality of first channels with the plurality of second channels is variable depending upon a degree of rotation of the rotatable shaft.

The variable multi-jet nozzle, the rotatable or movable disk, and the stationary disk are all preferably oriented perpendicular to the central axis. The plurality of first channels and the plurality of second channels are all preferably oriented generally parallel to the central axis. The rotatable or movable disk has a flat facing surface that abuts against a flat opposing surface of the stationary disk.

The device preferably has a plurality of multi-jet nozzles disposed in the flowpath each consisting of a rotatable or movable disk abutting against a stationary disk. Each of the plurality of variable multi-jet nozzles is preferably in a spaced relationship along the central axis and has a working chamber after each variable multi-jet nozzle.

Preferably, each of the plurality of first channels has a channel length S1 and each of the plurality of second channels has a channel length S2, with a ratio of S2 to S1 being in the range of $1 \leq S2/S1 \leq 10$. Also preferably, each of the plurality of first channels has a longitudinal cross-section in the shape of a converging cone and each of the plurality of second channels has a longitudinal cross-section in the shape of a diffusing cone. Alternatively, wherein each of the plurality of first channels when perfectly aligned with each of the plurality of second channels has a complete longitudinal cross-section in the shape of a Venturi tube.

In another alternative, each of the plurality of first channels and each of the plurality of second channels has a lateral cross-section in the shape of an angular sector bounded radially by radial lines $R_n$ and $R_{n+1}$ (n=1, 3, 5, . . . ) uniformly spaced from the central axis and bounded laterally by angular radii. The angular radii are preferably semi-circular or acutely angled. Each of the radial lines $R_n$ and $R_{n+1}$ (n=1, 3, 5, . . . ) bounding the angular sectors preferably has a ratio of radial distances of $R_n$ and $R_{n+1}$ in the range of $1.1 \leq R_{n+1}/R_n \leq 10$. In addition, each of the radial lines $R_{n+1}$ and $R_{n+3}$ (n=1, 3, 5, . . . ) bounding the angular sectors has a ratio of arc lengths of $L_{n+1}$ and $L_{n+3}$ in the range of $0.5 \leq L_{n+1}/L_{n+3} \leq 5$. The number of radial lines $R_n$ and $R_{n+1}$ (n=1, 3, 5, . . . ) bounding the angular sectors comprises from one to ten.

The present invention is also directed to a process for controlling hydrodynamic cavitation in a fluid using the variable flow-through cavitation device described above. The process begins with fully aligning the plurality of first channels with the plurality of second channels, wherein a flow cross-section of the through channels in the variable multi-jet nozzle is maximized. A fluid is then pumped through the flowpath at a pre-determined pump pressure of between 25 and 5,000 psi. Pumping the fluid through the variable multi-jet nozzles results in the generation of hydrodynamic cavitation. The intensity of the hydrodynamic cavitation generated in the fluid is then measured. Finally, the rotatable shaft is adjusted such that the plurality of first channels are no longer fully aligned with the plurality of second channels and the flow cross-section of the through channels in the variable multi-jet nozzle is reduced. This adjustment of the rotatable shaft changes the intensity of the hydrodynamic cavitation generated in the fluid, which is controlled through the reduction of the flow-cross-section.

The measuring step might include the steps of measuring an inlet pressure after hydrodynamic cavitation has been generated, and calculating the intensity of the hydrodynamic cavitation based upon the measured inlet pressure. The adjusting step includes turning the rotatable shaft until the inlet pressure equals the predetermined pump pressure set in the pumping step. The measuring and adjusting steps may be performed by an automatic control system in electrical communication with a servomotor connected to the rotatable shaft.

Alternatively, the measuring step might include measuring an intensity of pressure pulsations using a hydrophone in a working chamber after the variable multi-jet nozzle. The adjusting step might include turning the rotatable shaft so as to increase or decrease the intensity of pressure pulsations in the working chamber. Again, the measuring and adjusting steps may be performed by an automatic control system in electrical communication with the hydrophone and a servomotor connected to the rotatable shaft.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
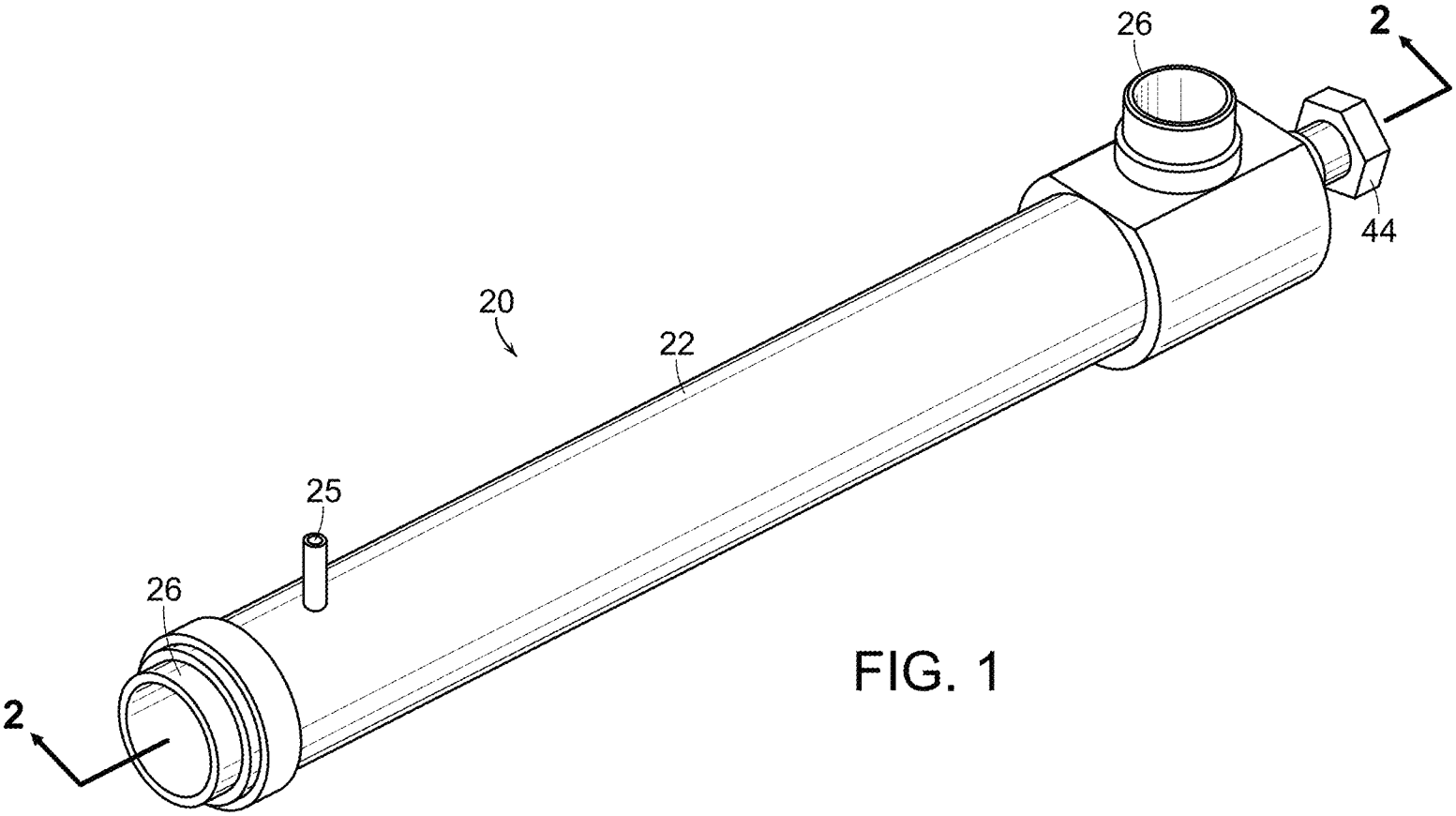
FIG. 1 is a perspective view of a preferred embodiment of the present compact, adjustable flow section of multi-jet nozzles, flow-through cavitation device of the present invention.

With reference now to FIGS. 1-6B, the flow-through, multi-stage, cavitation device adjustable flow section of multi-jet nozzles of the present invention is generally referred to by reference numeral 20. The device is especially suitable for processing fluids, such as organic solvents, crude oil, cell extracts, biological fluids, pharmaceutical emulsions and solutions, etc.

The term "fluid" includes but is not limited to a pure liquid comprised of identical molecules, a homogeneous or heterogeneous fluidic mixture, media liquefied prior to cavitation treatment, two- or multi-phase systems including crude oil, water/oil and/or other emulsions and dispersions, salt solutions, gases and/or other matter dissolved in suitable solvent(s), melted matter, dispersions, suspensions, slurries, liquefied gases, cell culture or broth, biological fluids, tissues, and the mixtures thereof.

The objects of the present invention are achieved by forcing fluids in the flow-through cavitation device adjustable flow section of multi-jet nozzles for controlled hydrodynamic cavitation to induce reactions and/or processes and/or change the properties of these fluids. The hydrodynamic cavitation process assumes the formation of vapor-filled bubbles within the fluid accelerated to a proper velocity. The phenomenon is called cavitation, because cavities form when the liquid pressure has been reduced to its vapor pressure. The bubbles expand and suddenly collapse upon reaching a high-pressure zone. The violent implosion causes a spike in pressure and temperature and intense shearing forces, resulting in reactions, mixing, emulsion formation and other effects.

Usually, when a multi-component fluidic mixture moves through a multi-stage cavitation apparatus the most volatile components will form vapor bubbles first and the other components will follow in the order of increasing boiling points. With the proposed device adjustable flow section of multi-jet nozzles the components will form vapor bubbles leading to different reactions in different chambers and exhibit the different behavior, depending on the size of opening of multi-jet nozzles, the properties of material from which the device is made.

Multiple embodiments of the flow-through, multi-stage, cavitation apparatus adjustable flow section of multi-jet nozzles are depicted in FIGS. 1-6B. The various parts of the apparatus 20 can be fabricated from a STELLITE® alloy, steel, stainless steel, aluminum, copper, brass, silver, zinc, nickel, PTFE, FEP or other fluoropolymers, poly (methyl methacrylate), PEEK, PBAT, PETG, PVC, polycarbonates, acrylic materials, polycrystalline diamond or other finished or unfinished metals and material(s).

Figure 2A:
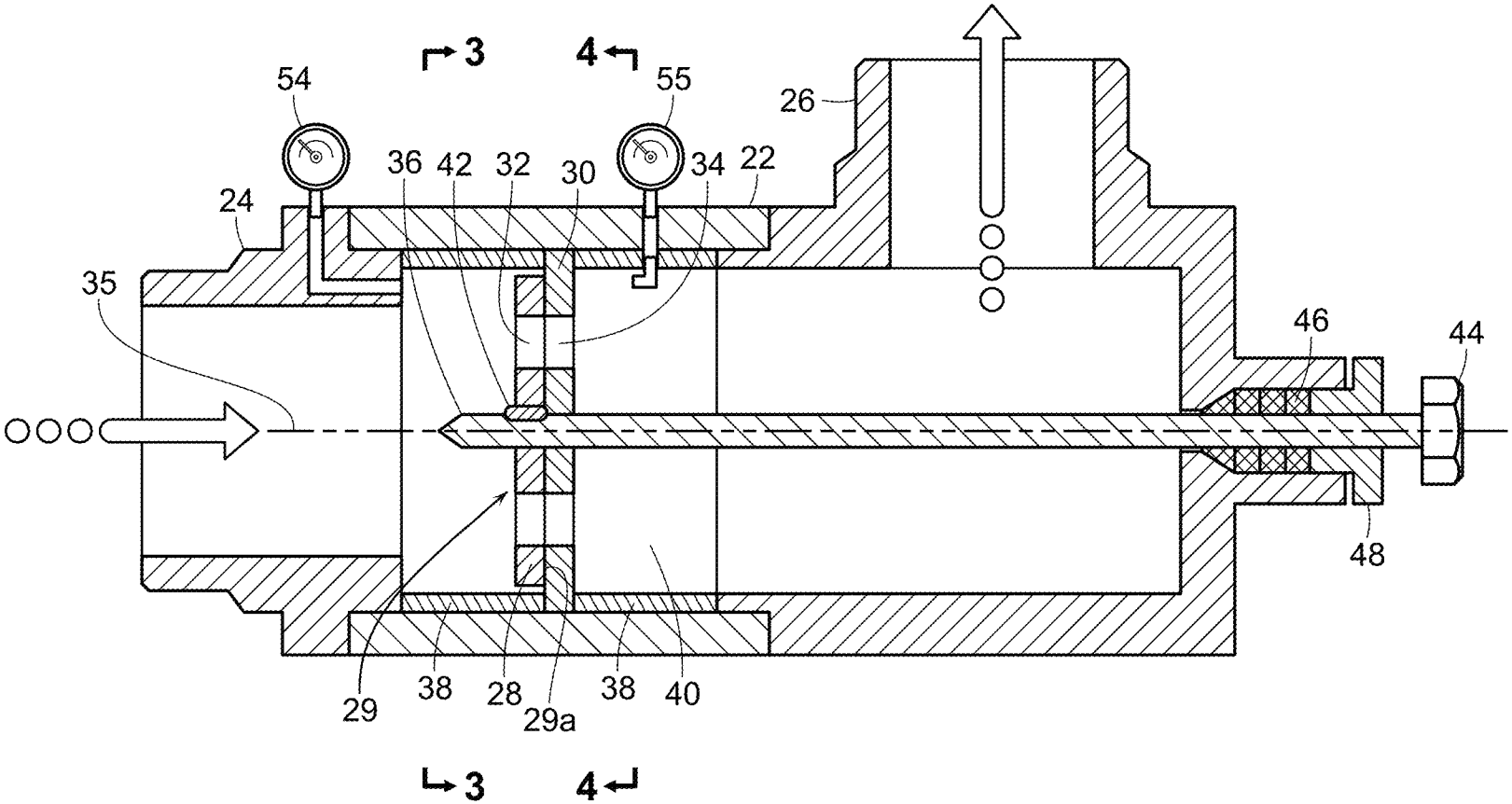
FIG. 2A is a cross-sectional view of a preferred embodiment of the present invention taken along line 2-2 of FIG. 1.
Figure 2B:
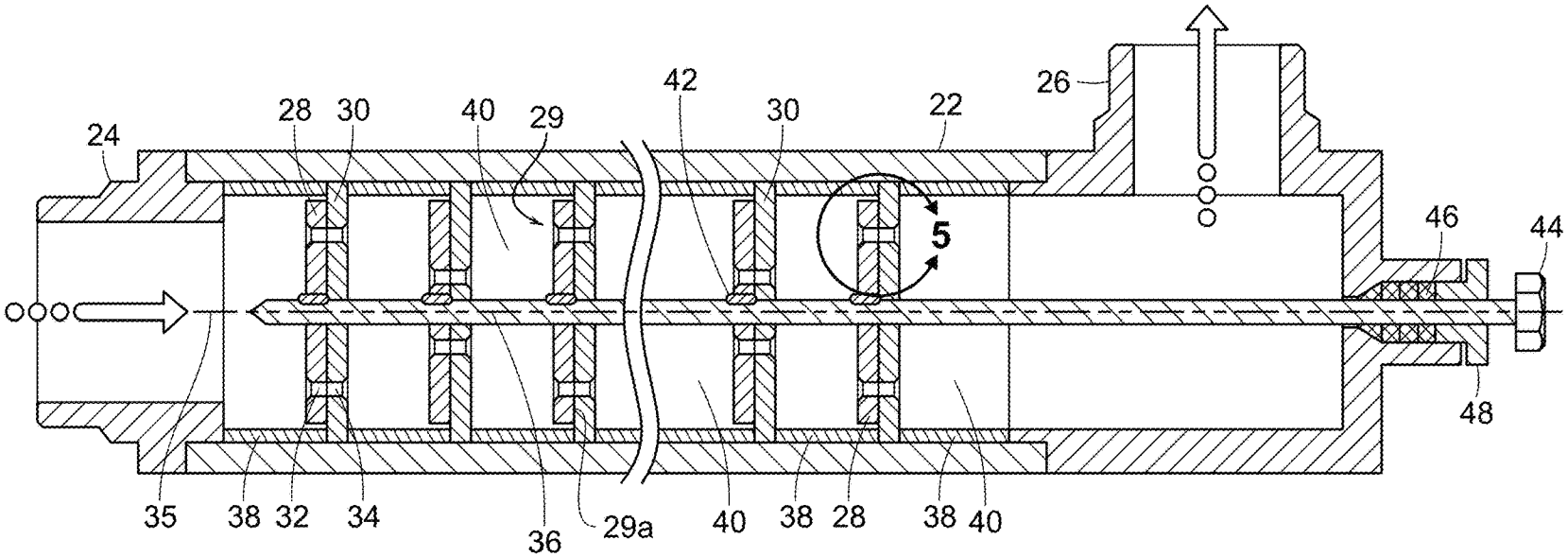
FIG. 2B is a cross-sectional view of an alternate preferred embodiment of the present invention taken along line 2-2 of FIG. 1.

The apparatus 20 comprises a housing 22 having an inlet pipe 24 and an outlet pipe 26 for connecting in-line with an industrial pipeline (not shown). Housing 22 preferably has a circular cross-section and may be provided with gas inlet port(s) 25. Inside housing 22 there is at least one variable multi-jet nozzle 29 (FIG. 2A) or a plurality of variable multi-jet nozzles 29 (FIG. 2B). A variable multi-jet nozzle 29 consists of two disks 28 and 30, in which there are multiple through channels 32 and 34.

Variable multi-jet nozzles 29 generate vortexes in fluid flow and intensive turbulent flow, thus creating microvortexes with locally decreased pressure which is equivalent to the pressure of heavy vapors of the processed fluid under the given temperature. When pressure in the local area is reduced to the pressure of heavy vapor, micro-bubbles or the so-called cavitation nuclei begin to grow. Micro-bubbles grow in size and turn into cavitation bubbles, which pulsate and collapse in the area of increased pressure. In order to create the conditions for pulsation and collapse of cavitation bubbles the flow-through cavitation device has working chambers. The flow-through cavitation generator contemplates sequential combination of cavitation zones—multi-jet nozzles as well as zones of increased pressure for cavitation bubbles collapse and pulsation—working chambers. The number of stages "cavitation bubbles generation zone—cavitation bubbles collapse zone" is determined by the degree of technological effect per one flow of processed fluid through flow-through cavitation generator. The minimum number of stages of cavitation bubbles generation and collapse can be as big as 1, but the maximum number can be theoretically unlimited and it can practically reach from 1 to 10-12 stages.

The number of variable multi-jet nozzles 29 is determined by the number of working areas for the hydrodynamic and cavitation effects on the fluid required to achieve the desired technological effect during processing of the liquid flow. For a particular process and the processed fluid with certain parameters, the number of working areas and, respectively, the number of consecutive variable multi-jet nozzles 29, is determined empirically.

The first disk 28 of a variable multi jet nozzle 29 along the fluid flow is rotatable about the central axis 35 of the apparatus 20. The second disk 30 of a variable multi jet nozzle 29 along the fluid flow, abuts against the first disk 28 along plane of contact 29*a* and is fixed, e.g., stationary within the apparatus 20. Fixation of stationary disks 30 is accomplished by bushings 38. Each stationary disk 30 is followed by working chamber 40 bounded by the walls of bushing 38, the preceding stationary disk 30 and subsequent movable disk 28, if any. The working chamber 40 located after stationary disk 30, which is the last along the flow, is bounded by the inner walls of the bushing 38 and the walls of outlet 26.

A shaft 36 extends along the central axis 35 through central openings of disks 28 and 30. Movable disks 28 are fixed to the shaft 36 by pin key 42 and rotate with the same. Rotation of the shaft 36 is carried out by rotation—manual or motorized—of shaft head 44. Shaft 36 passes through stationary disks 30 so as to allow free rotation of the shaft 36 relative to the disk 30. The shaft outlet is sealed by stuffing box 46, pressed by closing sleeve 48. Rotation of shaft 36 can be carried out manually or by using a special servomotor as described below.

Figure 3A:
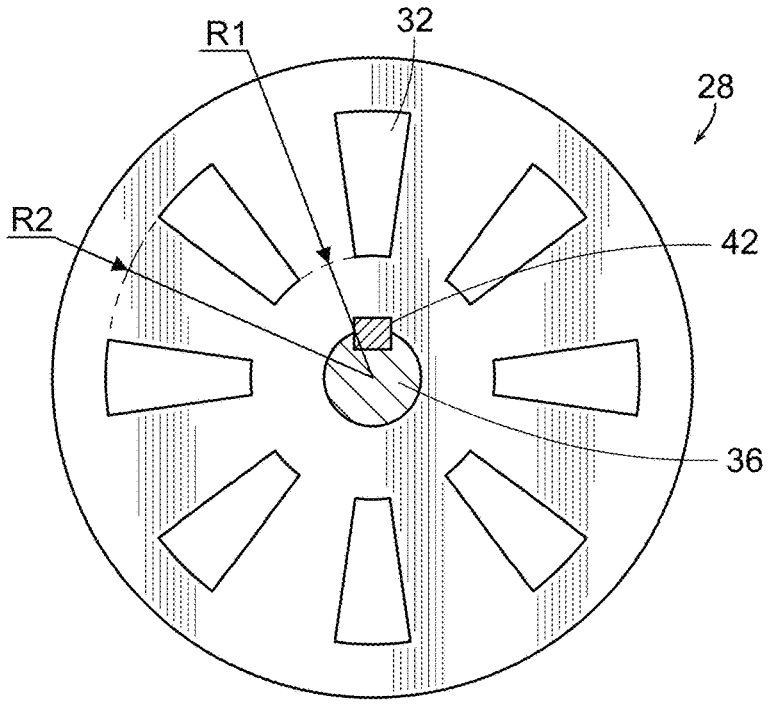
FIG. 3A is a cross-sectional view of a preferred embodiment of the movable disk taken along line 3-3 of FIG. 2A.

The number, shape and arrangement of channels 32 and 34 through disks 28 and 30 may have different embodiments. The cross section of the channels may have a shape of the angular sector bounded on one side by radial lines and radii $R_n$ and $R_{n+1}$ (n=1, 3, 5, . . . —odd numbers) that are equidistant from the central axis of the disk for each channel. In FIGS. 3A-4, the odd numbers represent the side of the angular sector closest to the central axis 35. FIGS. 3A-3D show four embodiments of channels 32 in movable disk 28. FIG. 4 only illustrates one embodiment of channels 34 in stationary disk 30 for convenience. The channels 34 of stationary disk 30 may have a shape and configuration in various forms similar to that shown and described for movable disk 28 in FIGS. 3A-3D.

Figure 3B:
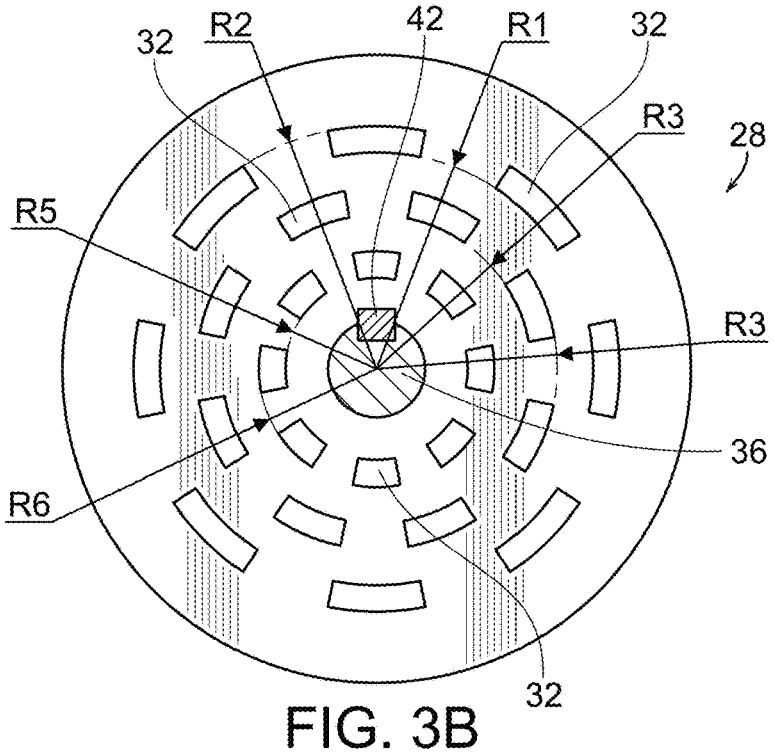
FIG. 3B is a cross-sectional view of an alternate preferred embodiment of the movable disk taken along line 3-3 of FIG. 2A.
Figure 3C:
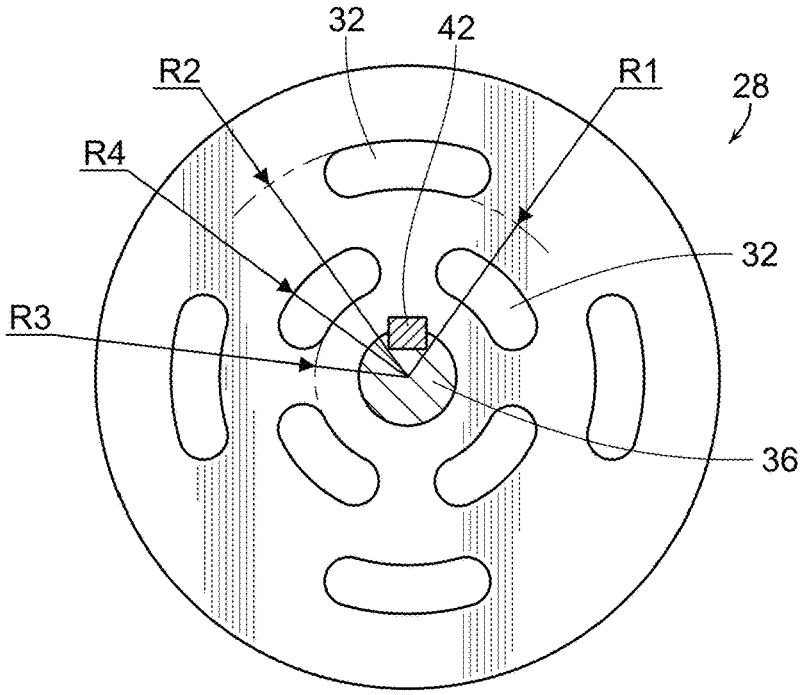
FIG. 3C is a cross-sectional view of another preferred embodiment of the movable disk taken along line 3-3 of FIG. 2A.
Figure 4:
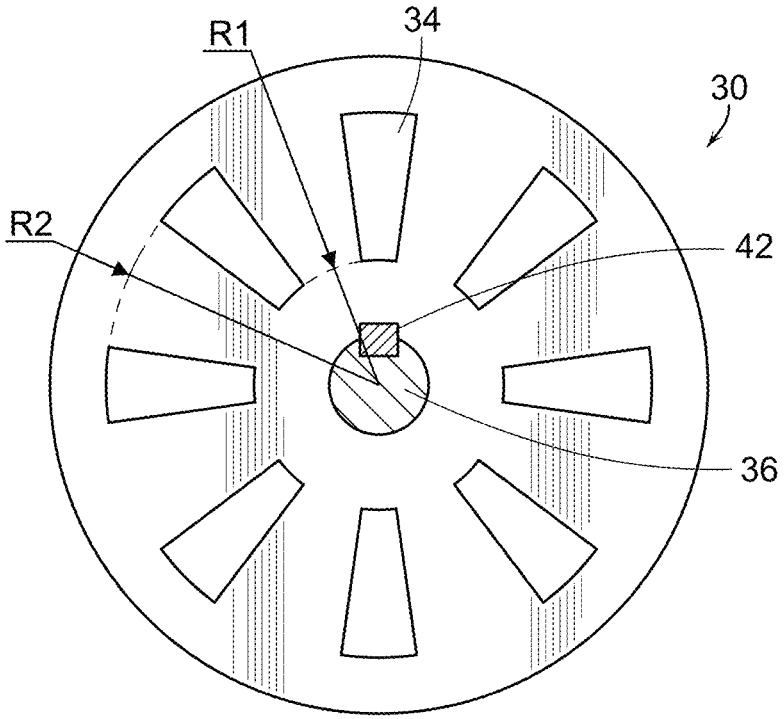
FIG. 4 is a cross-sectional view of a preferred embodiment of the stationary disk taken along line 4-4 of FIG. 2A.

Channels that have cross-sections in the shape of angular sectors bounded by radii $R_n$ and $R_{n+1}$ can be located at different distances from the central axis of the disk (FIG. 3B). Lateral lines of angular cross-sectional sectors of the channels can be shaped as semicircles (as shown in FIG. 3C), acute-angled, or any other shape. The number of channels limited by pairs of radii $R_n$ and $R_{n+1}$ can range from one to thirty-six or more, and it is determined by the geometrical dimensions of disks and pressure values and the fluid flow rate in the channels to create intensive cavitation. Radii $R_n$ and $R_{n+1}$ are determined in the plane of contact 29*a* of disks 28 and 30.

Figure 3D:
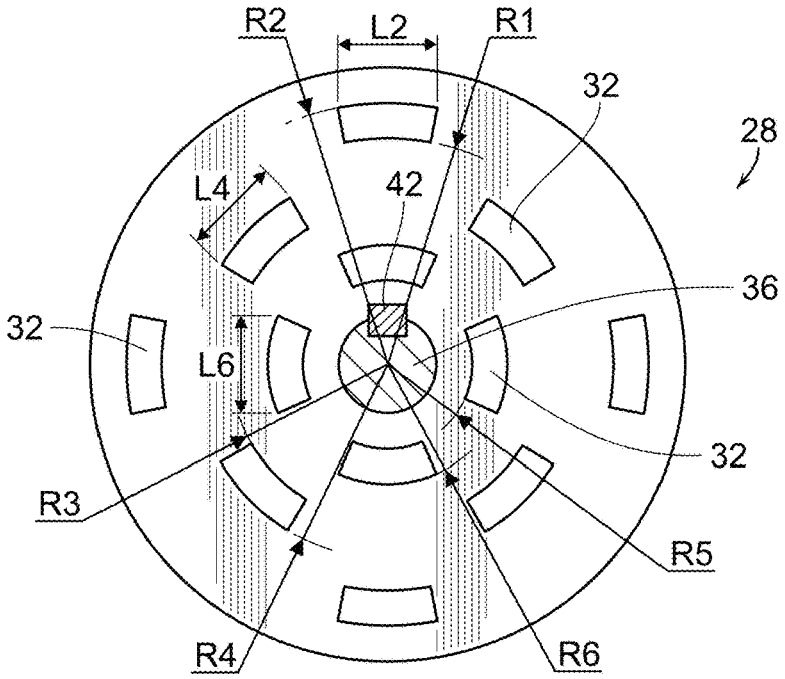
FIG. 3D is a cross-sectional view of yet another preferred embodiment of the movable disk taken along line 3-3 of FIG. 2A.

The ratio of the radii determining the size of one row of channels 32, 34 located on the same row can have the ratio $1.1 \leq R_{n+1}/R_n \leq 10$. The lengths of arcs $L_{n+1}$, on radii $R_{n+1}$, determining the size of the cross section of channels can have the ratio $0.5 \leq L_{n+1}/L_{n+3} \leq 5$ (as shown in FIG. 3D). The number of rows with radii $R_n$ and $R_{n+1}$, along which channels 32, 34 are located in the disks 28, 30, can reach one to ten and more, and they are determined by the geometric size of the disk, the pressure and the fluid flow rate in the channels 32, 34 to create intensive cavitation. While FIG. 4 only shows an embodiment of stationary disk 30 with channels similar in shape and configuration to those of movable disk 28 shown in FIG. 3A, a person skilled in the art will realize that the stationary disk 30 preferably has channels 34 that match the shape and configuration of the channels 32 in the movable disk 28 such as shown in FIGS. 3B-3D, or any other shape.

Figure 5A:
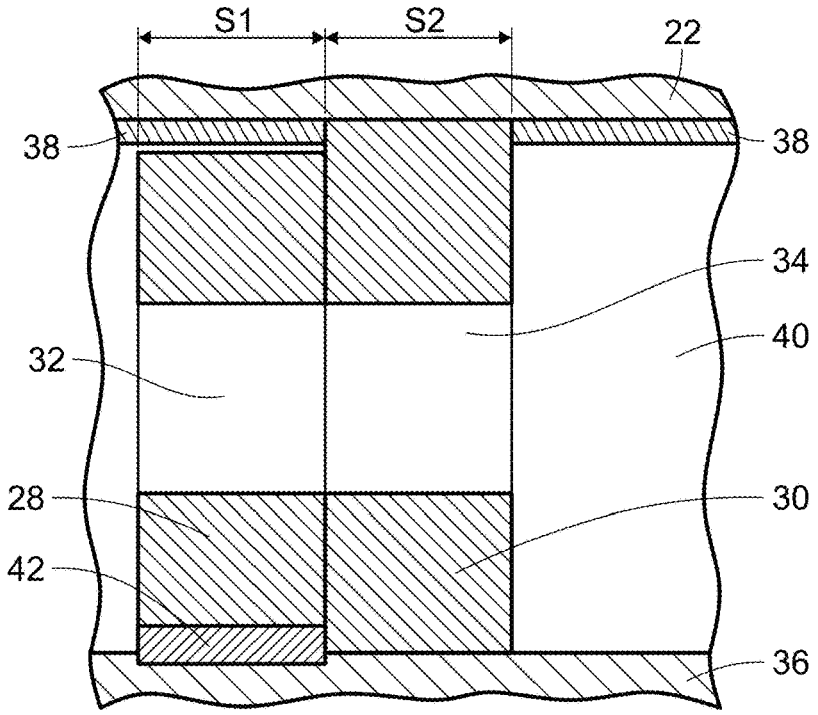
FIG. 5A is a circular section of a preferred embodiment of a channel through a multi-jet nozzle consisting of adjacent movable and stationary disks identified by circle 5 of FIG. 2B.
Figure 5B:
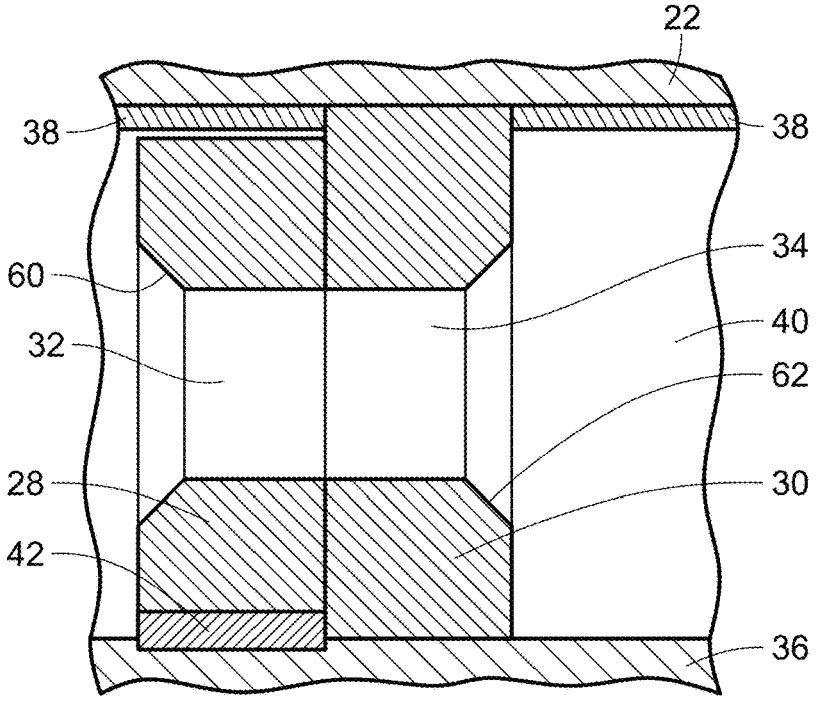
FIG. 5B is a circular section of an alternate preferred embodiment of a channel through a multi-jet nozzle consisting of adjacent movable and stationary disks identified by circle 5 of FIG. 2B.
Figure 5C:
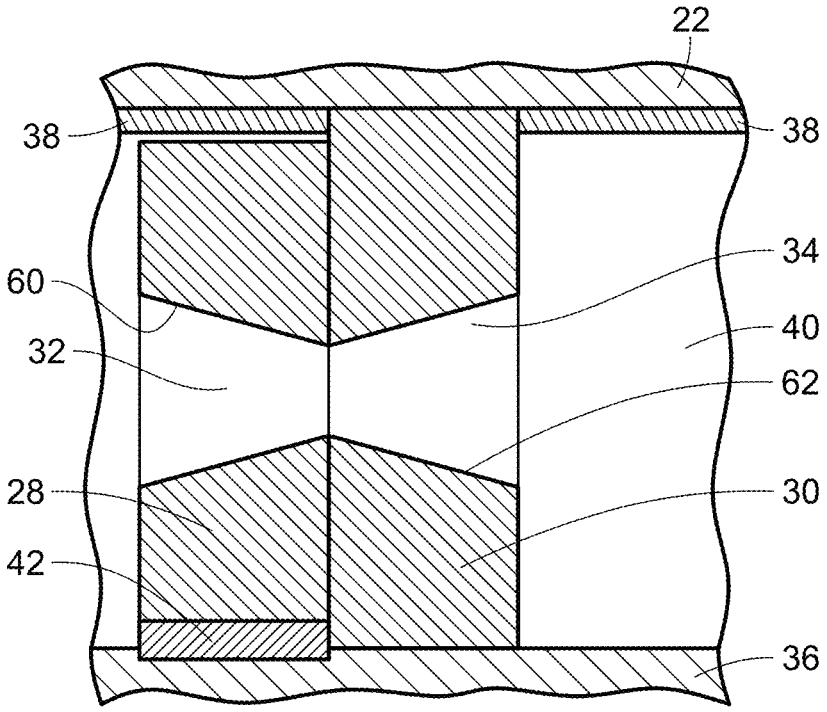
FIG. 5C is a circular section of another preferred embodiment of a channel through a multi-jet nozzle consisting of adjacent movable and stationary disks identified by circle 5 of FIG. 2B.
Figure 5D:
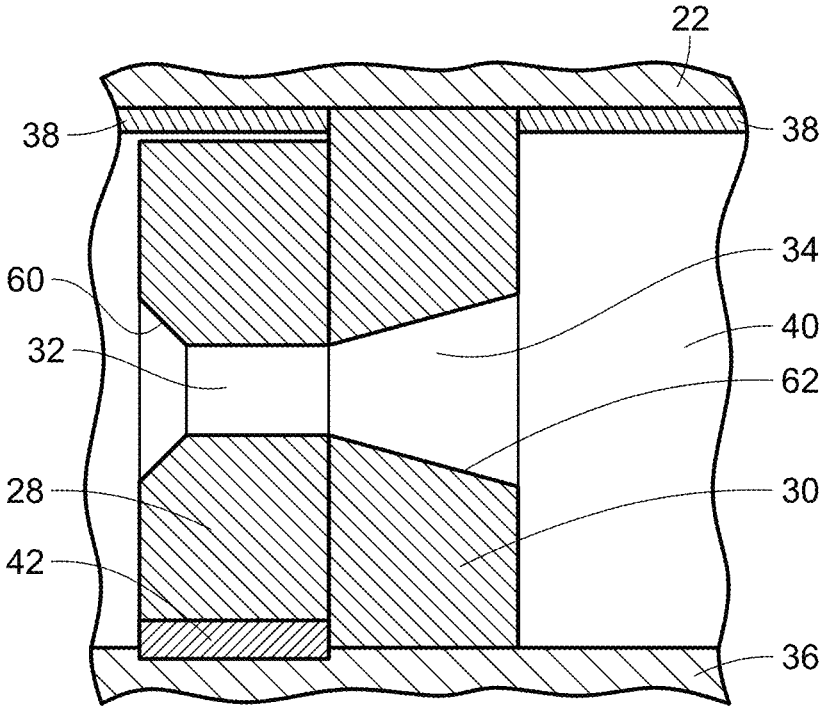
FIG. 5D is a circular section of yet another preferred embodiment of a channel through a multi-jet nozzle consisting of adjacent movable and stationary disks identified by circle 5 of FIG. 2B.

The longitudinal section of channels 32 and 34 can be rectangular (FIG. 5A), have partial and/or complete shape of a converging cone 60 in the channels 32 of movable disk 28, and the shape of diffuser 62 in channels 34 of stationary disc 30 (FIG. 5B, 5C). The shape of the longitudinal section in channel 32 of movable disk 28 and channels 34 of stationary disc 30 may have a cross section in the shape of Venturi tube (FIG. 5D). The ratio of the lengths S1 and S2 of channels 32 and 34 may be in the range of 1 S2/S1≤10.

Each variable multi jet nozzle 29 can have different variations in shape, position and size of the flow cross section area of channels 32 and 34 in disks 28 and 30. The number, shape, arrangement and size of flow area of channels 32, 34 of each variable multi jet nozzle 29 are selected depending on the characteristics of the processed liquid, the process parameters and calculated values of the hydrodynamic cavitation, which should be as small as possible.

The device 20 works as follows: fluid is fed by a pump or similar mechanism in inlet pipe 24 and moves through channels 32 of movable disk 28 and channels 34 of stationary disk 30, which are elements of the variable multi-jet nozzles 29. When fluid goes through the channel 32 and then through immediately adjacent channel 34 the fluid flow develops vortices, detached flows and cavitations. The above-mentioned effects influence the particles of the emulsion or any other heterogeneous fluid and lead to their intensive dispersion and homogenization, as well as separation of boundary layers on the particles. When cavitating bubbles get into the working chamber 40 in the direction of fluid flow they pulsate and collapse thus producing microscale pulsations and emissions of cumulative jets, as a result, they influence the particles of the processed fluid and the fluid as a whole, intensifying heat and mass transfer processes and destroying the substances.

The bubbles' implosion results in the release of a significant amount of energy that drives reactions and processes and heats the fluid. The size of the bubbles depends on the properties of the fluid, the design of the cavitation device, the pump pressure and other fluid conditions. In practice, the pump pressure is gradually increased until a cavitation field of proper intensity is established. In addition to determining the size, concentration and composition of the bubbles, and, as a consequence, the amount of released energy, the inlet pressure governs the outcome of triggered reactions.

Figure 6A:
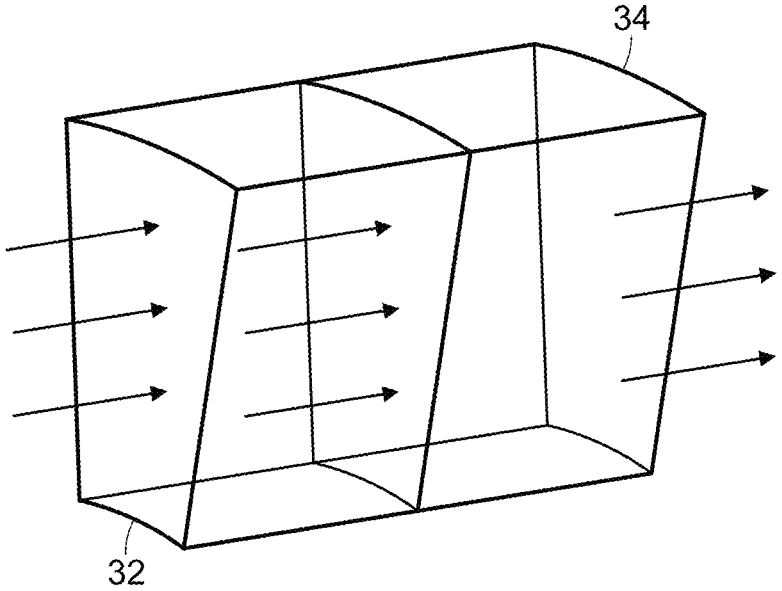
FIG. 6A depicts an embodiment of an arrangement of channels in a multi-jet nozzle.

To control the intensity of hydrodynamic cavitation occurring in the channels 32, 34 of the variable multi-jet nozzles 29, their design allows adjusting the value of their flow cross sectional area. In the initial position channels 32 in movable disks 28 are fully aligned with channels 34 in stationary disks 30 (FIG. 6A). In this position, the channels 32, 34 have the largest flow cross sectional area for fluid flow. An increase in the flow rate in the channels 32, 34 of the variable multi-jet nozzles 29 and an increase the intensity of cavitation, can be achieved by reducing the flow cross sectional area of the channels 32, 34. This is possible due to the rotation of movable disk 28, which rotates when shaft 36 is rotated. Rotation of the shaft 36 is accomplished by turning head 44 of the shaft 36 by hand or with a special servomotor.

Figure 6B:
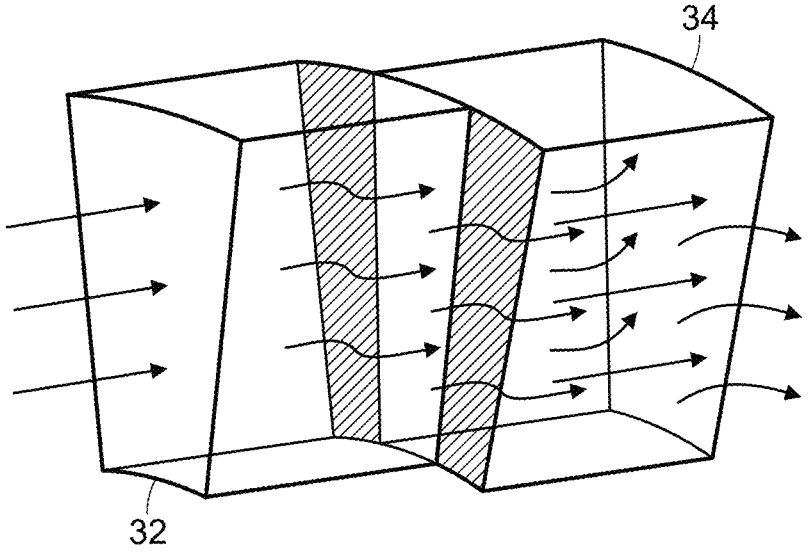
FIG. 6B depicts an embodiment of an adjusted arrangement of channels in a multi-jet nozzle.

When rotating disk 28, channels 32 and 34 are no longer fully aligned with the flow cross section profiles, and in the plane of contact 29*a* of disks 28 and 30 the flow cross sectional area of channels 32, 34 of the variable multi-jet nozzles 29 decreases. Part of the fluid flow moving through channel 32 hits the face of disk 30 which partially closes the flow cross section of channel 34 (FIG. 6B). Fluid flow is throttled through the narrower opening formed by the only partially aligned channels 32 and 34 in the contact plane 29*a* of movable disk 28 and stationary disk 30. Due to this constriction in available flow area, the flow rate increases rapidly and the pressure decreases by the throttling effect, which leads to the formation of vortices and growth of the bubbles of steam and gas, and the development of intensive cavitation.

When passing from channel 32 into channel 34 one part of the fluid flows parallel to the central axis 35, and the other part of the fluid flows at an angle (theoretically from 0 degrees to 90 degrees) to the central axis 35 in the plane of contact 29*a* of disks 28 and 30 (FIG. 6B). When the fluid flow gets into channel 34, it disperses fan-like from the direction parallel to the central axis 35. Getting into working chamber 40, the flow twists in the opposite direction of rotation of movable disk 28 relative to stationary disk 30. The twisting of the flow causes the intense vortex formation, the emergence of shear flows and the development of cavitation, which intensifies the chemical processes, heat and mass transfer in fluid flow, and dispersion of particles in the flow. The fluid flow passage along the twisted trajectory increases the duration of the fluid presence in the working chamber 40 and hydrodynamic effects (turbulence, cavitation, pressure fluctuations, etc.) on its components.

The intensity of cavitation at any position of the movable disk 28 relative to the stationary disk 30 and the cross section area of channels 32, 34 in the plane of contact 29*a* of disks 28 and 30 can be determined by calculation or by measurement of the pressure pulsation amplitude using a hydrophone 55 (FIG. 2A) during the collapse of cavitation bubbles. The hydrophone 55 can be placed in the working chamber 40 next to stationary disk 30 at any convenient point. This method of measuring the cavitation intensity is well known and standard.

Figure 7:
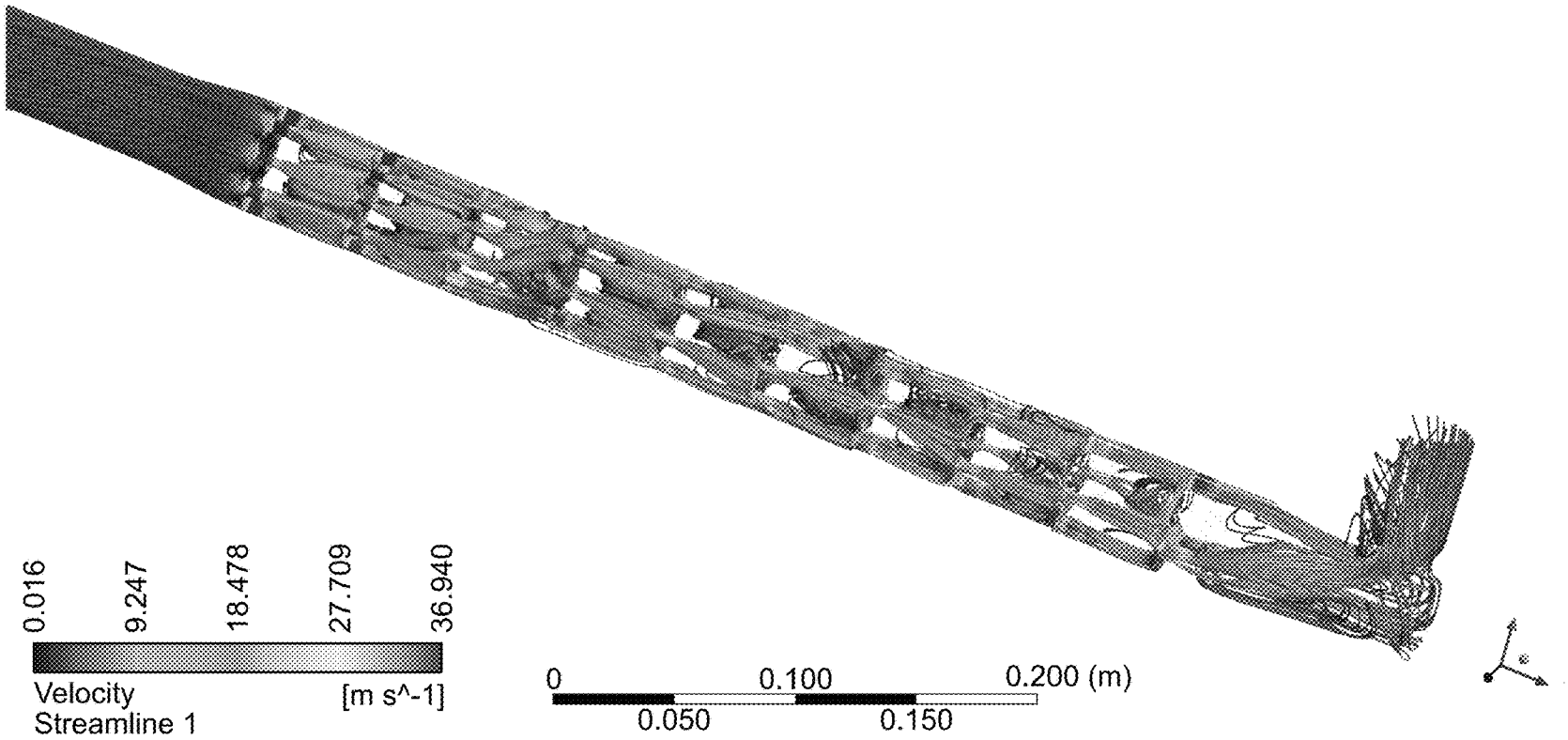
FIG. 7 is a computer model of fluid flow through a preferred embodiment of the device.

The calculation method for determining the degree of development of hydrodynamic cavitation is based on calculating the cavitation number for fixed positions of stationary and movable disks 28 and 30, channels 32 and 34 relative to each other. The starting position is the position of disks 28 and 30 at fully aligned channels 32 and 34. When rotating shaft 36 by a certain amount in degrees, the calculation of fluid flow parameters is carried out in a device by computer simulation, and the number of hydrodynamic cavitation is determined. An illustration of the calculation by this method for one embodiment is shown in FIG. 7. FIG. 7 shows the fluid flow line in the proposed device with the adjustable flow cross section of variable multi-jet nozzles 29.

The design of the device 20 with adjustable flow cross section of variable multi-jet nozzles 29 also allows maintaining the desired flow rate and the intensity of hydrodynamic cavitation by reducing pressure and flowing rate of the processed fluid. When reducing the pressure and flow rate at the inlet 24 of the device 20, the rate in the active zones also decreases. To maintain the processing intensity at the desired level, it is necessary to increase the flow rate. In this case, shaft 36 is rotated, which in turn rotates disk 28 relative to disk 30 so that the available flow area of variable multi-jet nozzles 29 decreases due to displacement of channel 32 overlapped by the face of stationary disk 30. In this way the hydraulic resistance of the variable multi-jet nozzles 29 increases, and so does the pressure at the inlet 24 of the device 20, thereby increasing the flow rate in the fluid flow zone from channel 32 into channel 34 and intensity of hydrodynamic and cavitation processing of fluid.

Figure 8:
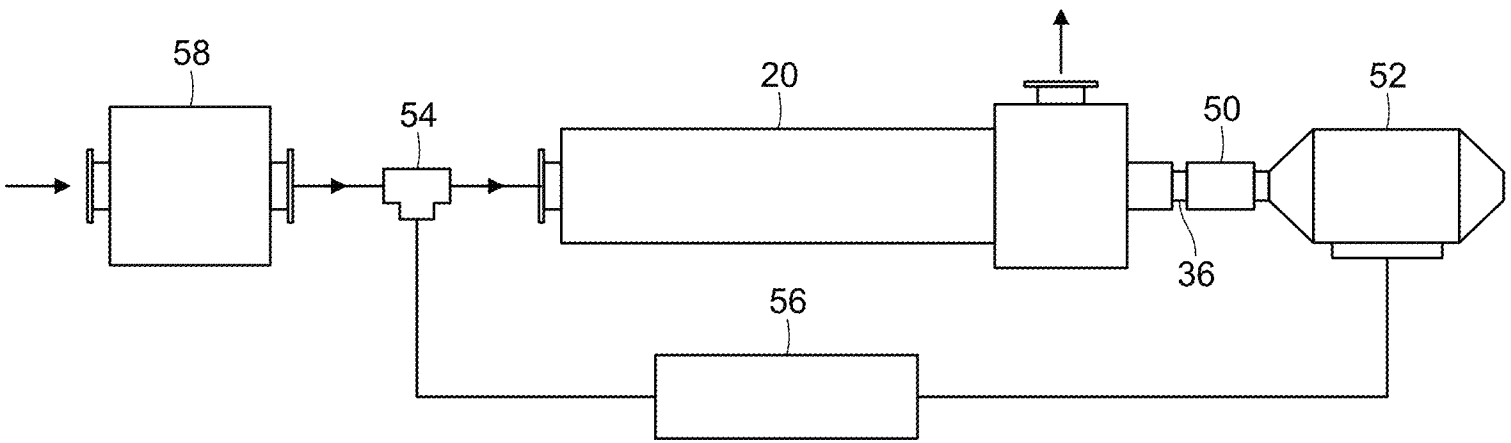
FIG. 8 is the diagram of control system for automatic rotation of the shaft and the movable disk(s) to adjust the intensity of cavitation in the working chamber(s).

Maintaining the required level of cavitation intensity may be carried out in an automatic mode. A system for the automatic rotation control of the shaft 36, movable disk 28, and the cavitation intensity in the working chamber 40 is shown in FIG. 8. Shaft 36 of the proposed device 20 is connected through coupling 50 to the shaft of servomotor or stepper motor 52. The inlet 24 of the device 20 fitted with pressure sensor 54. The pressure sensor signal is supplied to an automatic control system 56 (ACS) which controls rotating of the shaft 36 by the motor 52. The magnitude of the signal from pressure sensor 54 is continuously compared with a predetermined value of pressure provided by pump 58 at the inlet 24 of device 20.

If the inlet pressure drops, the automatic control system 56 will generate the command to turn the motor 52 by a specified amount which in turn rotates the shaft 36. When turning shaft 36 and disk 28, if the pressure returns to the predetermined value, ACS 56 will stop the motor 52 and the shaft 36 in the current position. If the pressure at the inlet 24 of device 20 is still less than the predetermined value, ACS 56 will repeat the command to turn the motor 52 and the shaft 36 of device 20, and will again compare the signal value of pressure sensor 54 with a predetermined pressure value until the inlet pressure reaches a desired level. There are several iterations of control commands of the ACS 56 to the servomotor until the pressure returns to the desired value. A similar control system can be implemented by using the hydrophone 55 in the working chamber 40 with a signal showing the intensity of pressure pulsations in the electronic form.

The shape of the flow cross section of channels 28 and 30 in the plane of contact 29*a* of disks 28 and 30 significantly influences the regularity of change of the flow area of the variable multi-jet nozzles 29. For large values of radii ratios $R_{n+1}/R_n$ and small values of arc length $L_{n+1}$, the flow cross section area of the variable multi-jet nozzles 29 varies considerably by turning shaft 36 at a certain angle. For small values of radii ratios $R_{n+1}/R_n$ and large values of arc length $L_{n+1}$ the flow cross section area of the variable multi-jet nozzles 29 varies insignificantly by turning shaft 36 at a certain angle.

When the number of variable multi-jet nozzles 29 with adjustable flow section is more than one, each variable multi-jet nozzle 29 may have a different number of channels 32 and 34 of its constituent disks 28 and 30. In a separate variable multi-jet nozzle 29 the shape of channels 32 and 34 (longitudinal and/or cross-sectional), their location along the end faces of disks 28 and 30 of variable multi-jet nozzles 29, the flow cross section area of each variable multi-jet nozzle 29 may vary. Patterns of change in flow cross section area of each variable multi-jet nozzle 29 may also be different. For example, in the first variable multi-jet nozzle 29 when rotating the movable disk 28 the flow area may vary by 50%. In the second variable multi-jet nozzle 29 it may change by 45%, and in the third variable multi-jet nozzle 29 it may change by 30%, and so on. Such varying change may occur at the same degree angle of rotation of shaft 36 and the rotation of movable disks 28 of each variable multi-jet nozzle 29.

The preferred embodiments of the present invention optimize the cavitation to afford uniform cavitation of fluids and hence, alteration thereof, by applying the most suitable pump pressure. The cavitation employed in accordance with the preferred embodiments of the present invention is achieved with a pump pressure selected from the range of approximately 25-5,000 psi to afford the highest efficiency of the treatment. However, as one familiar in the art can imagine, different media require different energies obtained through cavitation in order for their alteration to occur. Therefore, this range is in no way intended to limit use of the present invention.

It becomes an equipment cost decision which device 20 to employ, since a number of approaches are technically feasible, whether for large scale upgrading or the treatment of small batches. One approach for ensuring the best conditions is to create uniform cavitation throughout the fluid flow to avoid wasting energy. Additional lines and skid systems can be added to scale up the production capacity. These systems can be easily mounted and transported, making them suitable for both production and transportation.

The beneficial effects gained through the present invention cannot be achieved with a rotor-stator cavitation or sonic-/ultrasonic-induced cavitation because the conditions created by using the inventive apparatus 20, cannot be duplicated by other means. For example, cavitation bubbles form a barrier to transmission and attenuate sonic waves due to scattering and diversion, limiting the effectiveness of sonic-/ultrasonic-induced cavitation. Furthermore, ultrasonic radiation modifies liquid at specific locations, depending on the frequency, interference patterns and the source's power. The present invention overcomes these limitations, changing the composition of fluid in a uniform adjustable manner by supplying enough energy to drive target reactions and processes. Therefore, the inventive device 20 provides a superior means of upgrading fluids and producing unrivalled emulsions and dispersions.

The present invention uses the energy released as a result of the cavitation bubbles' implosion to alter fluids. Hydrodynamic cavitation is the formation of vapor-filled cavities in the fluid flow followed by the collapse of the bubbles in a high-pressure zone. In practice, the process is carried out as follows: the fluid is fed in the device's inlet passage. In the localized zone the flow accelerates causing its static pressure to drop resulting in the formation of bubbles composed of the vapors of compounds that vaporize under the specific conditions. When the bubbles move to the zone wherein the flow pressure increases, the bubbles collapse, exposing the vapors found within to high pressure and temperature, shearing forces, shock waves and/or electromagnetic radiation. Each bubble represents an independent miniature reactor, in which chemical and physical alterations take place. The resulting pressures and temperatures are significantly higher than those in many industrial processes. The further transformation of fluid results from the reactions and processes occurring in the adjacent layers of vapor/liquid.

The preferred embodiments of the present invention apply optimized levels of both pressure and temperature via the controlled flow-through cavitation. The process is independent of external conditions and provides a means for changing the chemical composition, physical properties and/or other characteristics of fluidic mixtures uniformly throughout the flow. In addition, important economic benefits are experienced through implementing the present invention. The optimized usage of a flow-through cavitation device serves to lower equipment, handling and energy costs, as it improves efficiency and productivity of the treatment.

EXAMPLES

Intense localized pressure impulses released because of micro jet formation and compression of cavitation bubbles followed by the implosion of the bubbles, excite molecules existing in the vapor phase and the adjacent layers of surrounding fluid transiently enriched with the high-boiling ingredient(s), thereby driving target reactions and processes.

Example 1A

Figure 9A:
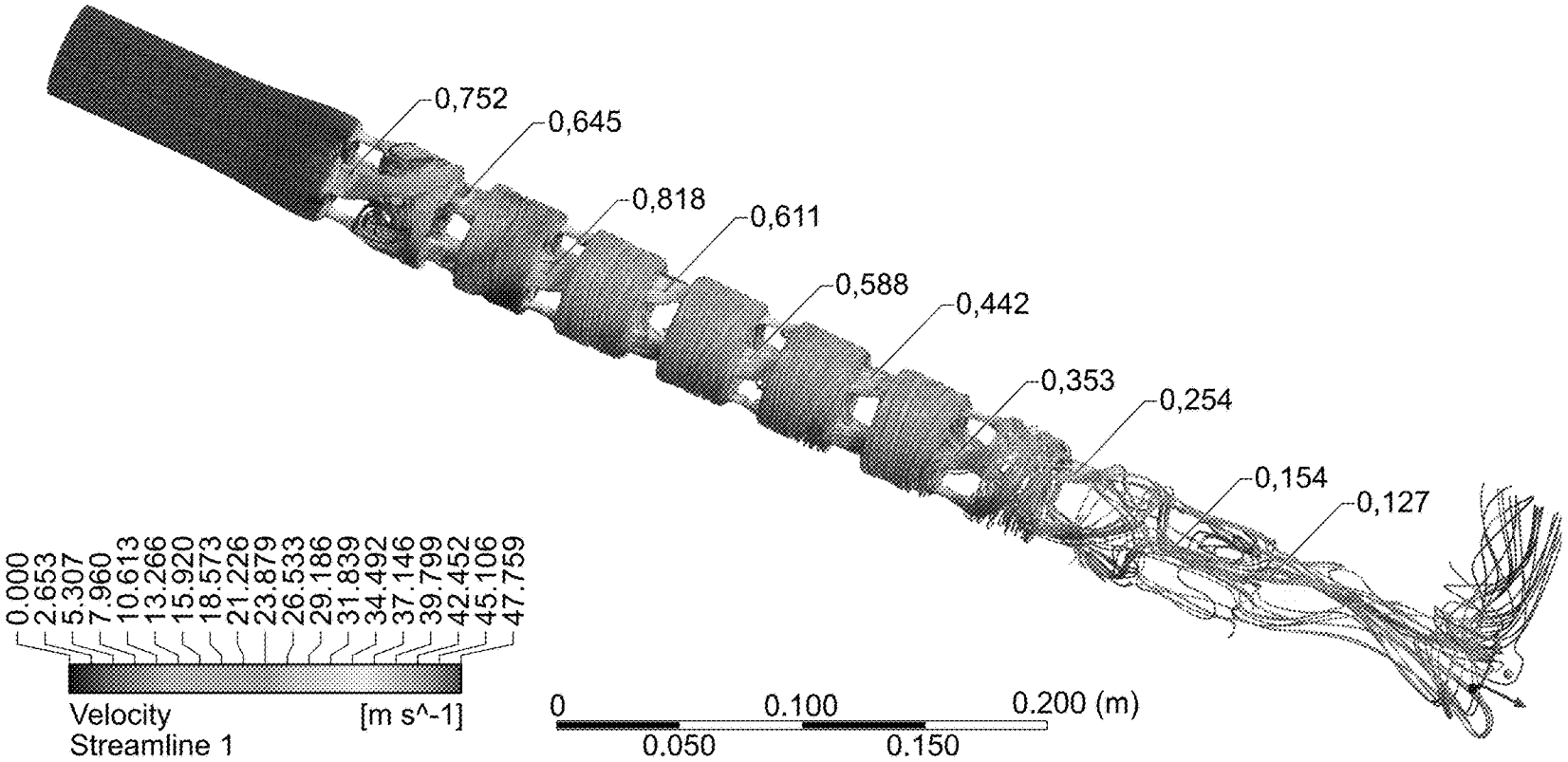
FIG. 9A is a computer model of fluid flow through another embodiment of the device at a first rotation angle of the shaft and movable disk(s) relative to the fixed disk.

Values for cavitation number, calculated with the specialized software ANSYS for the cavitation device 20 (length 70 cm, diameter 6 cm, 10 multi-jet nozzles) which is similar to the apparatus shown in FIG. 2B. The calculation was performed for the initial position of disks 28 and 30 at fully aligned channels 32 and 34 (FIG. 6A). The channels have the Venturi tube profile in a longitudinal section (FIG. 5D). The device 20 was operated at a flow rate of 50 gpm and an inlet pressure of 272 psi. The calculation results at 25 C are shown in FIG. 9A in the form of water flow lines. Cavitation numbers were calculated for each working chamber 40 following a variable multi-jet nozzle 29, and had values of 0.752, 0.645, 0.818, 0.611, 0.583, 0.442, 0.353, 0.254, 0.154, and 0.127, respectively, assuming flow moves from left to right.

Example 1B

Figure 9B:
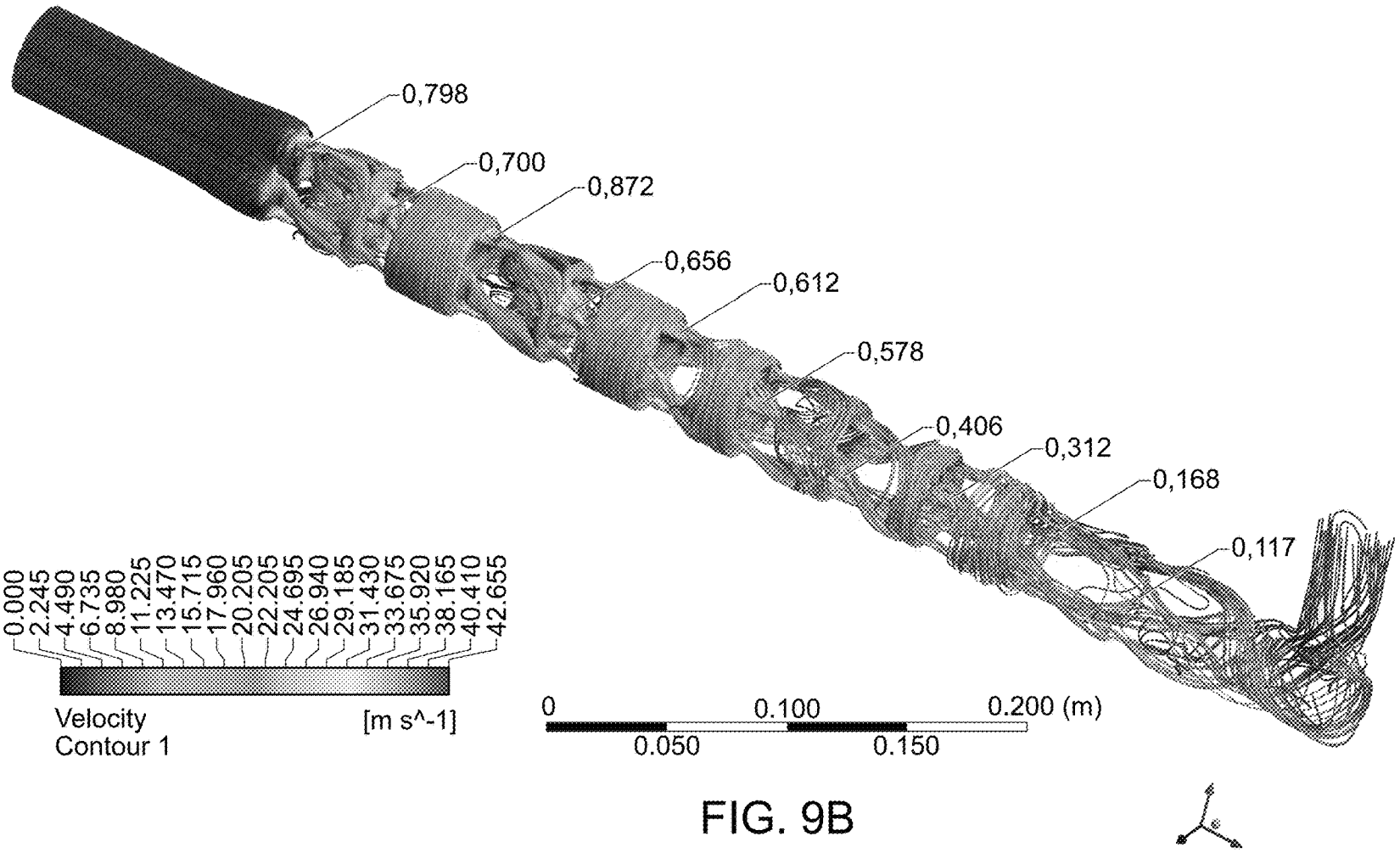
FIG. 9B is a computer model of fluid flow through the same embodiment of the device in FIG. 9A at a second rotation angle of the shaft and movable disk(s) relative to the fixed disk.

Values for cavitation number, calculated with the specialized software ANSYS for the cavitation device 20 (length 70 cm, diameter 6 cm, 10 multi-jet nozzles) which is similar to the apparatus shown in FIG. 2B. The calculation was performed for the position of disks 28 rotated by 5 degrees relative to disk 30 from the fully aligned position. Channels 32 and 34 are partially offset from each other, as in the example shown in FIG. 6B. The channels have the Venturi tube profile in the longitudinal section (FIG. 5D). The device 20 was operated at a flow rate of 40 gpm and an inlet pressure of 279 psi. The calculation results are shown in FIG. 9B in the form of water flow lines at 25 C. Cavitation numbers were calculated for each working chamber 40 following a variable multi-jet nozzle 29, and had values of 0.798, 0.700, 0.872, 0.656, 0.612, 0.578, 0.406, 0.312, 0.168, and 0.117, respectively, assuming flow moves from left to right.

Example 1C

Figure 9C:
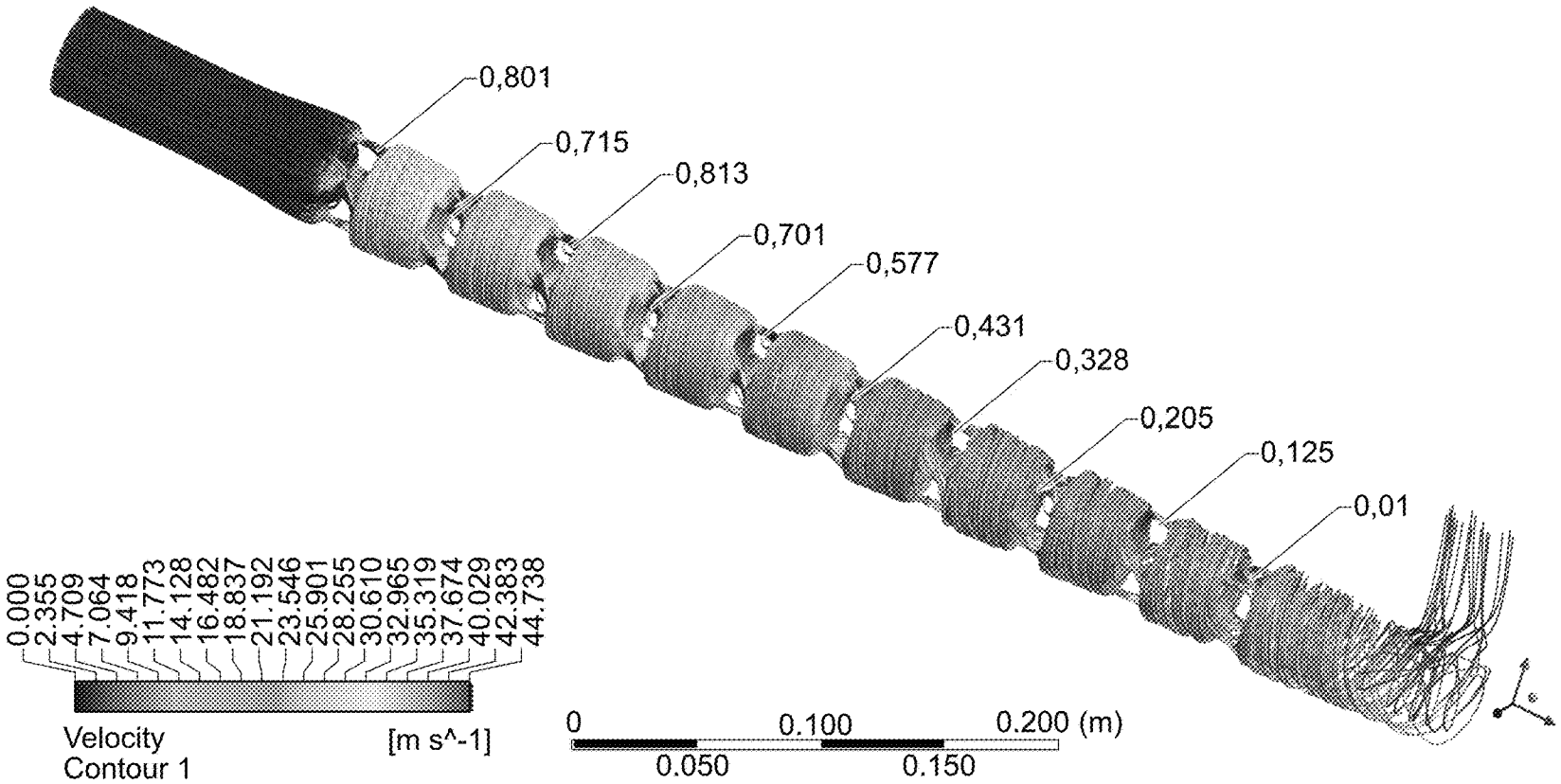
FIG. 9C is a computer model of fluid flow through the same embodiment of the device in FIG. 9A at a third rotation angle of the shaft and movable disk(s) relative to the fixed disk.

Values for cavitation number, calculated with the specialized software ANSYS for the cavitation device 20 (length 70 cm, diameter 6 cm, 10 multi-jet nozzles) which is similar to the apparatus shown in FIG. 2B. The calculation was performed for the position of disks 28 rotated by 18 degrees relative to disk 30 from the fully aligned position. Channels 32 and 34 are partially offset from each other, as similar to the example shown in FIG. 6B. The channels have the Venturi tube profile in longitudinal section (FIG. 5D). The device 20 was operated at a flow rate of 20 gpm and an inlet pressure of 275 psi. The calculation results are shown in FIG. 9C in the form of water flow lines at 25 C. Cavitation numbers were calculated for each working chamber 40 following a variable multi-jet nozzle 29, and had values of 0.801, 0.715, 0.813, 0.701, 0.577, 0.431, 0.328, 0.205, 0.125, and 0.010, respectively, assuming flow moves from left to right.

As seen from the calculation results shown in 9A, 9B and 9C with decreasing fluid flow rate through the device, it is possible to obtain similar pressure values at the inlet 24 and the cavitation numbers in each variable multi-jet nozzle 29, as well as to maximize the flow rate of 50 gpm for the fully aligned position of disks 28 and 30. This is achieved by rotating movable disk 28 relative to stationary disk 30, displacement of channels 32 relative to channels 34 and reduction in the overall flow cross section.

Example 2

The stability of emulsions that have found numerous applications in industry is commonly evaluated by measuring the amount of oil separated from a water/oil emulsion. The stability of prepared emulsions is characterized with a coefficient $k_t$, value for which was calculated by using the following expression: $k_t=V_o/V$, where $V_o$ is the volume of oil separated from the emulsion at time t and V is the total volume. First, vegetable oil was added to an equal amount of water followed by mechanical agitation at 20° C. for 10 min. Second, emulsions were prepared with a cavitation device 20 (length 70 cm, diameter 6 cm, 10 multi-jet nozzles) similar to that shown in FIG. 2B, the number of channels 32 and 34 in disk 28 and 30 was four each. In the longitudinal section, channels 32 and 34 had venturi tube profiles (FIG. 5D).

Example 2A

The position of disks 28 and 30 was established with fully aligned channels 32 and 34 (FIG. 6A). The mixture was fed in the inventive device 20 at a pump pressure of 270 psi and a rate of 50 gallons per minute and subjected to either 2-passes or 20-passes through the device 20. Then 100 ml of the prepared emulsion was transferred to a transparent measuring cylinder. The value of coefficient $k_t$ was determined at different times (Table 1). The obtained data confirmed that water/oil emulsions prepared with no surfactants by using the present device are more stable than those prepared by mechanical agitation.

TABLE 1

| | t | | | | | | |
|---|---|---|---|---|---|---|---|
| | 0.5 min | 30 min | 1 h | 2 h | 3 h | 4 h | 6 h |
| Mechanical Agitation $k_t$, | 0.1 | 0.39 | 0.5 | 0.5 | 0.5 | 0.5 | 0.5 |
| 2 Passes $k_t$, | 0.00 | 0.09 | 0.23 | 0.38 | 0.45 | 0.489 | 0.50 |
| 20 Passes $k_t$, | 0.00 | 0.13 | 0.19 | 0.26 | 0.29 | 0.32 | 0.32 |

Example 2B

Emulsification was carried out for the position of disks 28 rotated by 18 degrees relative to disks 30 from the fully aligned position. Channels 32 and 34 were partially offset from each other, as in the example shown in FIG. 6B. The mixture was fed through the inventive device 20 at a pump pressure of 275 psi and a rate of 20 gallons per minute and subjected to either 2-passes or 20-passes through the device 20. Then 100 ml of the prepared emulsion was transferred to a transparent measuring cylinder. The value of coefficient $k_t$ was determined at different times (Table 2). The obtained data confirm that water/oil emulsions prepared with no surfactants by using the present device are more stable than those prepared by mechanical agitation.

TABLE 2

| | t | | | | | | |
|---|---|---|---|---|---|---|---|
| | 0.5 min | 30 min | 1 h | 2 h | 3 h | 4 h | 6 h |
| Mechanical Agitation $k_t$, | 0.1 | 0.39 | 0.5 | 0.5 | 0.5 | 0.5 | 0.5 |
| 2 Passes $k_t$, | 0.00 | 0.08 | 0.21 | 0.33 | 0.432 | 0.47 | 0.49 |
| 20 Passes $k_t$, | 0.00 | 0.11 | 0.17 | 0.23 | 0.27 | 0.30 | 0.31 |

As can be seen from Example 2A and Example 2B, the stability of prepared emulsions at different values of the flow rate through the device, but at the same values of pressure in the inlet pipe was about the same. This confirms the same degree of cavitation intensity in the device. Since the pressure on the inlet pipe was the same in both examples, therefore, the flow rates were approximately equal by varying the flow cross section of channels 32 and 34 in disks 28 and 30 of variable multi-jet nozzles 29.

Although the description above contains much specificity, this description should not be construed as limiting the scope of the invention, but as merely providing illustrations of some of the preferred embodiments of the present invention offering many potential uses for the products of the invention. The readers should appreciate that many other embodiments of the present invention are possible as understood by those skilled in this art. For example, there are many approaches to creating cavitation in fluids in addition to the ones described above. Accordingly, the scope of the present invention should be determined solely by the appended claims and their legal equivalents, rather than by the given examples.

Although several embodiments of the invention have been described in detail for purposes of illustration, various modifications of each may be made without departing from the spirit and scope of the invention. Accordingly, the invention is not to be limited, except as by the appended claims.

What is claimed is:

1. A variable flow-through cavitation device, comprising:

an elongated housing having an inlet and an outlet defining a flowpath;

a rotatable shaft disposed along a central axis of the elongated housing;

a variable multi-jet nozzle disposed in the flowpath, wherein the variable multi-jet nozzle comprises a movable disk abutting against a stationary disk, wherein the movable disk is fixedly secured to the rotatable shaft and freely rotatable relative to the elongated housing, wherein the stationary disk is fixedly secured to the elongated housing and the rotatable shaft passes freely through the stationary disk; and a plurality of first channels through the movable disk and a plurality of second channels through the stationary disk that when aligned together form through channels in the variable multi-jet nozzle, wherein an alignment of the plurality of first channels with the plurality of second channels is variable depending upon a degree of rotation of the rotatable shaft, and wherein the through channels in the variable multi-jet nozzle have a complete longitudinal cross-section in the shape of a Venturi tube.

2. The variable flow-through cavitation device of claim 1, wherein the variable multi-jet nozzle, the movable disk, and the stationary disk are all oriented perpendicular to the central axis.

3. The variable flow-through cavitation device of claim 1, wherein the plurality of first channels and the plurality of second channels are all oriented generally parallel to the central axis.

4. The variable flow-through cavitation device of claim 1, wherein the movable disk has a flat facing surface that abuts against a flat opposing surface of the stationary disk.

5. The variable flow-through cavitation device of claim 1, wherein the variable multi-jet nozzle comprises a plurality of variable multi-jet nozzles disposed in the flowpath in a spaced relationship along the central axis and a working chamber after each variable multi-jet nozzle.

6. The variable flow-through cavitation device of claim 1, wherein each of the plurality of first channels has a channel length S1 and each of the plurality of second channels has a channel length S2, wherein a ratio of S2 to S1 is in the range of $1 \leq S2/S1 \leq 10$.

7. The variable flow-through cavitation device of claim 1, wherein each of the plurality of first channels and each of the plurality of second channels has a lateral cross-section in the shape of an angular sector bounded radially by radial lines $R_n$ and $R_{n+1}$ (n=1, 3, 5, . . . ) uniformly spaced from the central axis and bounded laterally by angular radii.

8. The variable flow-through cavitation device of claim 7, wherein the angular radii are semi-circular or acutely angled.

9. The variable flow-through cavitation device of claim 7, wherein each of the radial lines $R_n$ and $R_{n+1}$ (n=1, 3, 5, . . . ) bounding the angular sectors has a ratio of radial distances of $R_n$ and $R_{n+1}$ in the range of $1.1 \leq R_{n+1}/R_n \leq 10$.

10. The variable flow-through cavitation device of claim 9, wherein each of the radial lines $R_{n+1}$ and $R_{n+3}$ (n=1, 3, 5, . . . ) bounding the angular sectors has a ratio of arc lengths of $L_{n+1}$ and $L_{n+3}$ in the range of $0.5\ L_{n+1}/L_{n+3} \leq 5$.

11. The variable flow-through cavitation device of claim 7, wherein the number of radial lines $R_n$ and $R_{n+1}$ (n=1, 3, 5, . . . ) bounding the angular sectors comprises from one to ten.

12. A variable flow-through cavitation device, comprising:

an elongated housing having an inlet and an outlet defining a flowpath;

a rotatable shaft disposed along a central axis of the elongated housing;

a variable multi-jet nozzle disposed in the flowpath, wherein the variable multi-jet nozzle comprises a movable disk abutting against a stationary disk, wherein the movable disk is fixedly secured to the rotatable shaft and freely rotatable relative to the elongated housing, wherein the stationary disk is fixedly secured to the elongated housing and the rotatable shaft passes freely through the stationary disk; and a plurality of first channels through the movable disk and a plurality of second channels through the stationary disk that when aligned together form through channels in the variable multi-jet nozzle, wherein each of the plurality of first channels has a longitudinal cross-section comprising a converging cone and each of the plurality of second channels has a longitudinal cross-section comprising a diffusing cone, and wherein an alignment of the plurality of first channels with the plurality of second channels is variable depending upon a degree of rotation of the rotatable shaft.

* * * * *